US007507002B2

(12) United States Patent
Ulmer et al.

(10) Patent No.: US 7,507,002 B2
(45) Date of Patent: Mar. 24, 2009

(54) REFLECTOR WITH DE-COUPLING INTERFACE LAYER

(75) Inventors: Kurt M. Ulmer, Corvallis, OR (US); Kuohua Wu, Tucson, AZ (US)

(73) Assignee: Hewlett Packard Development Company, L.P., Houston, TX (US)

( * ) Notice: Subject to any disclaimer, the term of this patent is extended or adjusted under 35 U.S.C. 154(b) by 298 days.

(21) Appl. No.: 11/173,320

(22) Filed: Jul. 1, 2005

(65) Prior Publication Data

US 2007/0002569 A1 Jan. 4, 2007

(51) Int. Cl.
*F21V 7/00* (2006.01)
*F21V 13/02* (2006.01)

(52) U.S. Cl. ..... 362/307; 362/296; 362/341; 362/343; 362/344; 362/264

(58) Field of Classification Search ..... 362/296, 362/307, 341, 343, 344, 254
See application file for complete search history.

(56) References Cited

U.S. PATENT DOCUMENTS

| | | | | | |
|---|---|---|---|---|---|
| 3,944,320 | A | | 3/1976 | McLintic | |
| 4,021,659 | A | | 5/1977 | Wiley | |
| 4,260,931 | A | | 4/1981 | Wesselink et al. | |
| 4,642,737 | A | * | 2/1987 | Meyers, Jr. | 362/511 |
| 4,720,660 | A | | 1/1988 | Whelan | |
| 4,924,134 | A | | 5/1990 | Westlund, Jr. et al. | |
| 4,964,829 | A | * | 10/1990 | Westlund et al. | 313/113 |
| 5,076,674 | A | * | 12/1991 | Lynam | 359/274 |
| 5,318,830 | A | * | 6/1994 | Takamatsu et al. | 359/359 |
| 5,894,196 | A | | 4/1999 | McDermott | |
| 5,898,267 | A | | 4/1999 | McDermott | |
| 5,923,116 | A | | 7/1999 | Mercer et al. | |
| 5,976,702 | A | * | 11/1999 | Yoneda et al. | 428/429 |
| 6,252,338 | B1 | | 6/2001 | Bergman et al. | |
| 6,492,031 | B1 | * | 12/2002 | Moriyama et al. | 362/296 |
| 6,563,255 | B1 | * | 5/2003 | Collins | 362/296 |
| 6,586,864 | B2 | | 7/2003 | Zhou et al. | |
| 6,648,709 | B2 | | 11/2003 | Teichgraeber et al. | |
| 6,710,522 | B2 | | 3/2004 | Fransen | |
| 6,768,260 | B2 | | 7/2004 | Fukunaga et al. | |
| 6,840,633 | B2 | * | 1/2005 | Davis et al. | 362/300 |
| 6,848,797 | B1 | | 2/2005 | Gillich et al. | |
| 6,863,418 | B2 | | 3/2005 | Masuoka et al. | |
| 7,063,423 | B2 | * | 6/2006 | Fujimori et al. | 362/296 |

FOREIGN PATENT DOCUMENTS

| | | | |
|---|---|---|---|
| WO | WO 94/09392 | A | 4/1994 |
| WO | WO 03/023816 | A2 | 3/2003 |

OTHER PUBLICATIONS

*Why HP Digital Projectors?*, printed May 20, 2005 from internet, www.hp.com/sbso/product/projector/whydigitalprojector (4 pgs.).
Jeff Tyson, *How Movie Projectors Work*, printed May 20, 2005 from Internet, How Stuff Works, www.stuffo.howstuffworks.com/movie-projector4 (4 pgs.).

* cited by examiner

*Primary Examiner*—Sandra L O'Shea
*Assistant Examiner*—William J Carter

(57) ABSTRACT

A method for forming a reflector includes depositing a decoupling material on an ultraviolet light and infra-red light absorption layer that is supported by a substrate which is spun.

18 Claims, 4 Drawing Sheets

FIG. 2
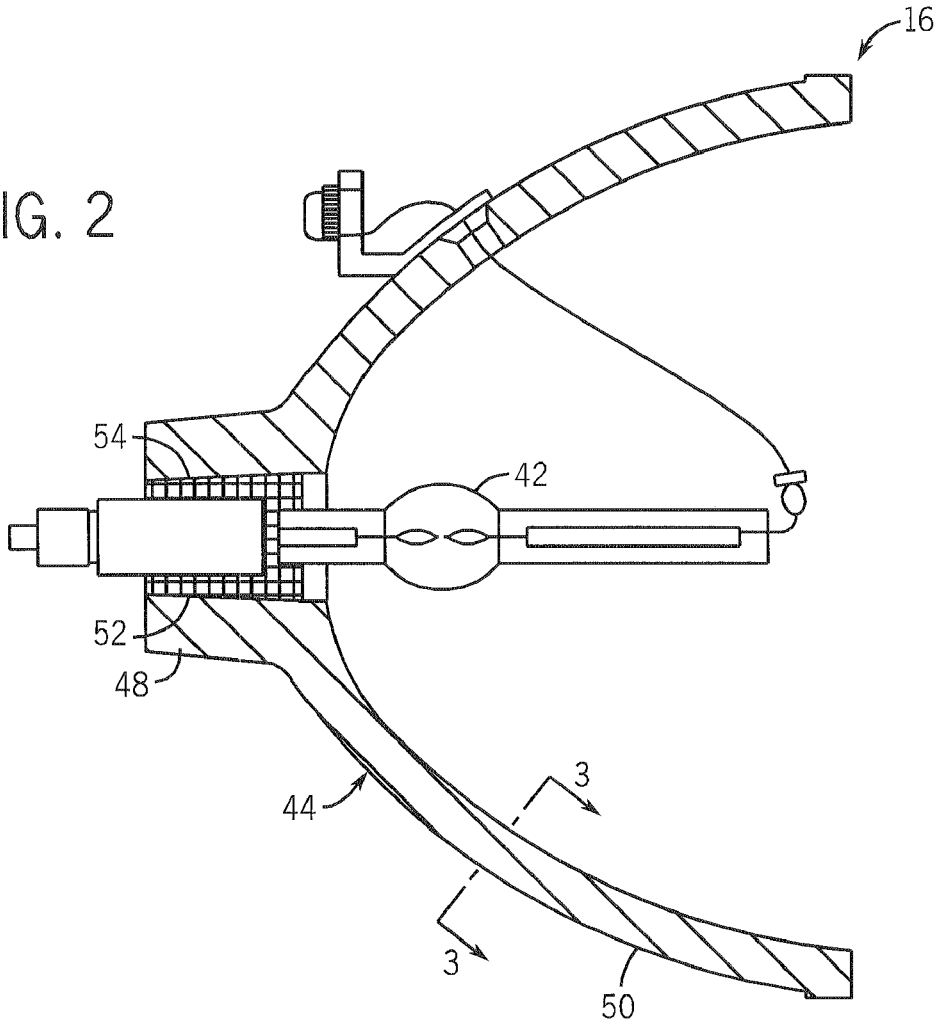
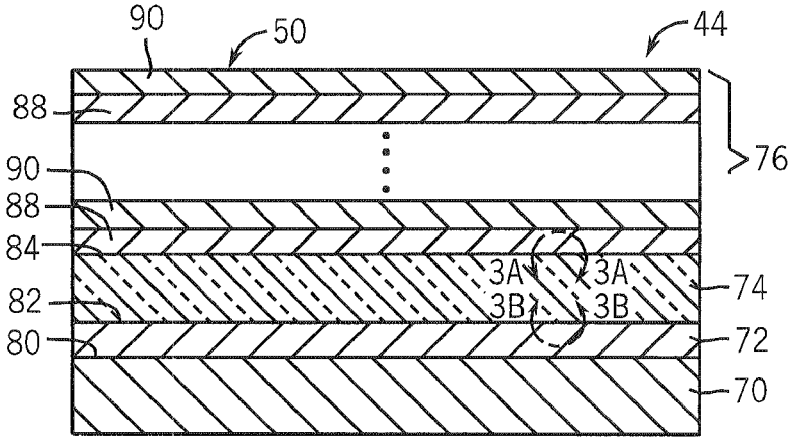
FIG. 3

FIG. 3A
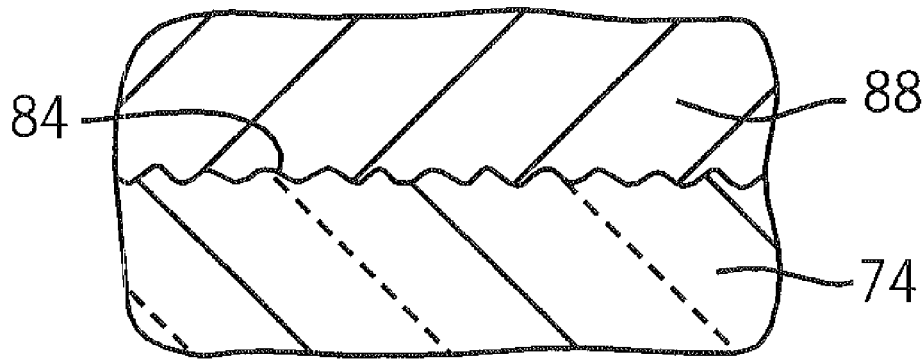
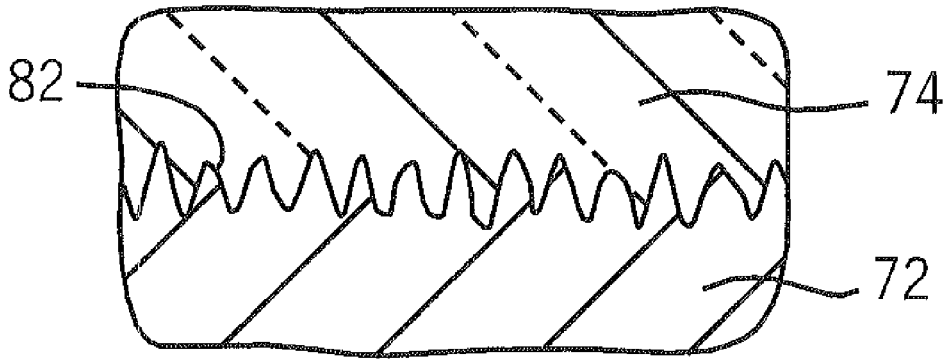
FIG. 3B

REFLECTOR WITH DE-COUPLING INTERFACE LAYER

BACKGROUND

Lamps, such as those used in projectors, may include a reflector to reflect and direct light. In some lamps, the reflector may include a dielectric interference coating that is deposited upon an underlying layer that is formed by spraying or dipping. Because the underlying layer is formed from spraying or dipping, available materials for the underlying layer are limited. In addition, with spraying or dipping, it is difficult to achieve a uniform surface thickness. The surface irregularities of the underlying layer that may result from spraying or dipping may impair performance of the reflector.

BRIEF DESCRIPTION OF THE DRAWINGS

FIG. 2 is a sectional view of a light source of the projector of FIG. 1 according to one example embodiment.

FIG. 3 is a sectional view of the light source of FIG. 2 taken along line 3-3 according to one example embodiment. FIG. 3A is an enlarged fragmentary sectional view taken alone line 3A-3A of FIG. 3. FIG. 3B is an enlarged fragmentary sectional view taken along line 3B-3B of FIG. 3.

DETAILED DESCRIPTION OF THE EXAMPLE EMBODIMENTS

Figure 1:
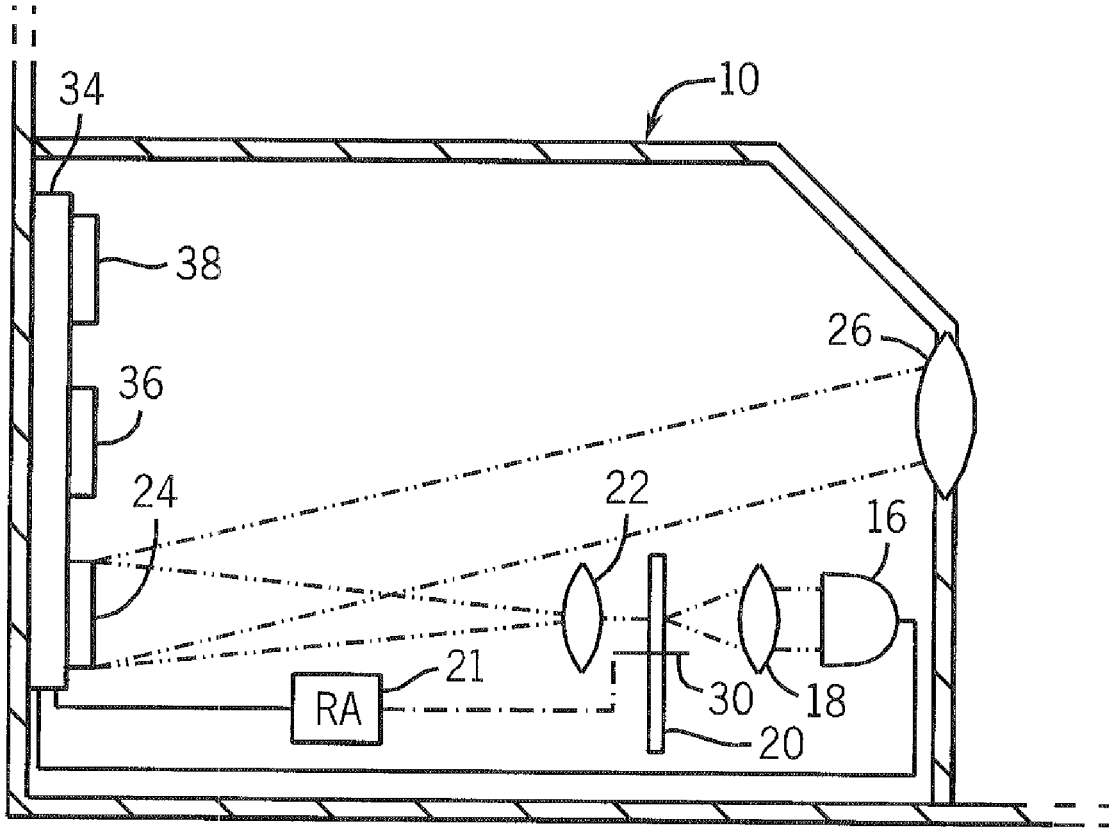
FIG. 1 is a schematic illustration of a projector according to one example embodiment.

FIG. 1 schematically illustrates a projector 10 which includes a lamp 16 according to one example embodiment. As will be described in greater detail hereafter, lamp 16 includes a decoupling layer that underlies an optical coating and that is formed by spin coating. Because the decoupling layer is formed by spin coating, the decoupling layer may have improved surface uniformity or smoothness and may be formed from a wider range of materials. As a result, performance of lamp 16 may be enhanced.

In the particular example illustrated, projector 10 comprises a digital light processing (DLP) projector. In addition to lamp 16, projector 10 generally includes optics 18, color wheel 20, rotary actuator 21, optics 22, digital micromirror device (DMD) 24 and projection lens 26. Lamp 16 comprises a source of light (burner) such as an ultra high pressure (UHP) arc lamp and reflector configured to emit light toward optics 18. In other embodiments, other sources of light may be used such as metal halide lamps and the like. Optics 18 are generally positioned between lamp 16 and color wheel 20. Optics 18 condenses the light from lamp 16 towards DMD 24. In one embodiment, optics 18 may comprise a light pipe positioned between lamp 16 and color wheel 20.

Color wheel 20 comprises an optic component configured to sequentially image color. Color wheel 20 generally comprises a disk or other member having a plurality of distinct filter segments positioned about the rotational axis 30 of the wheel and arranged such that light from optics 18 passes through such filter segments towards DMD 24. In one particular embodiment, color wheel 20 may include circumferentially arranged portions including red, green, blue, and clear. In another embodiment, color wheel 20 may include circumferentially arranged portions or segments corresponding to each of the three primary colors: red, green and blue. In yet another embodiment, color wheel 20 may include multiple segments of each of the primary colors. For example, color wheel 20 may include a first red segment, a first green segment, a first blue segment, a second red segment, a second green segment and a second blue segment. In still other embodiments, color wheel 20 may include other segments configured to filter light from lamp 16 to create other colors.

Rotary actuator 21 comprises a device configured to rotatably drive color wheel 20 such that light from lamp 16 sequentially passes through the filter segments. In one embodiment, rotary actuator 21 rotates color wheel 20 at a predetermined substantially constant speed. In another embodiment, rotary actuator 21 may be configured to rotate color wheel 20 at varying speeds based upon control signals received from processor 36. In one embodiment, rotary actuator 21 includes a motor and an appropriate transmission for rotating color wheel 20 at a desired speed. In other embodiments, rotary actuator 21 may comprise other devices configured to rotatably drive color wheel 20.

Optics 22 comprises one or more lenses or mirrors configured to further focus and direct light that has passed through color wheel 20 towards DMD 24. In one embodiment, optics 22 may comprise lenses which focus and direct the light. In another embodiment, optics 22 may additionally include mirrors which re-direct light onto DMD 24.

In one embodiment, DMD 24 comprises a semiconductor chip covered with a multitude of minuscule reflectors or mirrors which may be selectively tilted between "on" positions in which light is re-directed towards lens 26 and "off" positions in which light is not directed towards lens 26. The mirrors are switched "on" and "off" at a high frequency so as to emit a gray scale image. In particular, a mirror that is switched on more frequently reflects a light gray pixel of light while the mirror that is switched off more frequently reflects darker gray pixel of light. In this context "gray scale", "light gray pixel", and "darker gray pixel" refers to the intensity of the luminance component of the light and does not limit the hue and chrominance components of the light. The "on" and "off" states of each mirror are coordinated with colored light from color wheel 20 to project a desired hue of color light towards lens 26. The human eye blends rapidly alternating flashes to see the intended hue of the particular pixel in the image being created. In the particular examples shown, DMD 24 is provided as part of a DLP board 34 which further supports a processor 36 and associated memory 38. Processor 36 and memory 38 are configured to selectively actuate the mirrors of DMD 24. In one embodiment, processor 36 and memory 38 are also configured to control rotary actuator 21. In other embodiments, processor 36 and memory 38 may alternatively be provided by or associated with another (not shown) controller.

Lens 26 receives selected light from DMD 24 and projects the reflected light towards a screen (not shown). Although projector 10 is illustrated and described as a DLP projector, projector 10 may alternatively comprise other projectors having other components configured such that projector 10 sequentially projects a series of colors towards a screen so as to form a visual image upon the screen.

In yet other embodiments, projector 10 may comprise other forms of projectors which utilize a light source such as lamp 16. For example, in one embodiment, projector 10 may alternatively include a Fabry-Perot interferometric device configured to reflect different colors or wavelengths of light depending upon a thickness of a selectively adjustable optical cavity.

In such an embodiment, color wheel 20 and rotary actuator 21 may also be omitted. In still other embodiments, projector 10 may have other configurations.

FIG. 2 illustrates one example of the lamp 16 in detail. As shown by FIG. 2, lamp 16 includes burner 42 and reflector 44. Burner 42 comprises a device configured to emit light to be projected by lamp 16. In one embodiment, burner 42 comprises a device configured to emit both visible light, ultraviolet light and infra-red light. In one embodiment, burner 42 comprises a high pressure mercury arc lamp. In other embodiments, burner 42 may comprise other devices configured to emit light including visible light, ultraviolet light and infra-red light.

Reflector 44 comprises one or more structures configured to reflect and direct light emitted by burner 42. In the particular embodiment illustrated, reflector 44 generally includes base or hub 48 and bowl 50. Hub 48 comprises that portion of reflector 44 to which burner 42 is mounted or supported. In the particular example illustrated, hub 48 includes an opening 52 through which burner 42 extends for connection to an external power source. Opening 52 is sealed about burner 42. In one embodiment, opening 52 is at least partially filled with a cement 54 to seal and connect burner 42 to base 48. In other embodiments, the burner may be sealed or joined to base 48 by other materials or structures.

Bowl 50 comprises that portion of reflector 16 configured to surround and reflect the visible light emitted by burner 42. In the particular example illustrated, bowl 50 is a generally ellipsoidal structure configured to surround and direct light emitted by burner 42. In other embodiments, bowl 50 may have any curved or angled shape. FIG. 3 is a sectional view of bowl 50 taken along line 3-3 of FIG. 2. As shown by FIG. 3, bowl 50 of reflector 44 generally includes substrate 70, ultraviolet light and infra-red light absorption layer 72, de-coupling layer 74, and optical coating 76. Substrate 70 comprises one or more layers of material serving as a base or foundation for reflector 44 and providing bowl 50 of reflector 44 with its ellipsoidal shape. In the particular example illustrated, substrate 70 is substantially impervious to ultraviolet light and infra-red light such that ultraviolet light and infra-red light do not substantially pass through substrate 70 and are substantially reflected by substrate 70. In one embodiment, substrate 70 is formed from a metal. In one particular embodiment, substrate 70 is formed from aluminum. In the particular example illustrated, substrate 70 includes a surface 80 upon which absorption layer 72 is formed or deposited. Surface 80 has a reduced finish. In one example, surface 80 has a surface finish of less than or equal to about 50 nanometers greater than or equal to about 0 nanometers and nominally about 20 nanometers. Because substrate 70 is formed from a metal, such as aluminum, substrate 70 has a relatively high degree of thermal conductivity, providing reflector 44 with beneficial heat dissipation characteristics. Because the substrate is formed from a metal, such as aluminum, reflector 44 is lightweight and may have a lower cost as compared to reflectors formed from other materials. Because surface 80 of substrate 70 has a reduced finish, the fabrication costs of substrate 70 and of reflector 44 may be reduced. In other embodiments, substrate 70 may be formed from other materials.

Infra-red light absorption layer 72 comprises one or more layers of one or more materials configured to absorb ultraviolet light and infra-red light emitted by burner 42 (shown in FIG. 2). In one embodiment, absorption layer 72 has a thickness of at least about 0.5 micrometers less than or equal to about 10 micrometers and nominally about 5 micrometers. Absorption layer 72 is deposited or otherwise formed upon or coupled to substrate 70 so as to overlie surface 80. Absorption layer 72 has a surface 82 upon which decoupling layer 74 is formed.

In one embodiment, surface 82 has a relatively rough finish to facilitate absorption of ultraviolet light and infra-red light. According to one embodiment, surface 82 has a surface finish of at least about 0.1 micrometers of less than or equal to about 10 micrometers and nominally about 1 micrometer. In other embodiments, surface 82 may have other surface finishes.

According to one example embodiment, absorption layer 72 is formed by an anodization process using an acidic electrolyte containing a nickel chemistry such as $2NiCO_3Ni(OH)_25H_2O$ or by a subsequent addition of a carbon-based pigment as an absorption media. In other embodiments, absorption layer 72 may be formed using other materials and other processes.

De-coupling layer 74 comprises one or more layers of material deposited, formed or otherwise coupled to absorption layer 72 over surface 82 of absorption layer 72. De-coupling layer 74 is configured to transmit ultraviolet light and infra-red light to absorption layer 72 for absorption while also providing a relatively smoother surface 84 (shown enlarged in FIG. 3B) against which multilayer optical coating 76 may be deposited, formed or otherwise coupled to layer 74. Because de-coupling layer 74 has a surface 84 which is relatively smoother than surface 82, subsequently applied layers, such as multilayer optical coating 76 may perform as intended. In the particular example illustrated, the relatively smoother surface 84 provided by de-coupling layer 74 facilitates a relatively large specular reflection by multilayer optical coating 76 in the optical portion of the spectrum (visible light). In particular embodiments, de-coupling layer 74 provides a further smoother surface as compared to surface 80 of substrate 70.

De-coupling layer 74 further has appropriate optical properties such as an appropriate refractive index and extinction coefficient. In particular, de-coupling layer 74 has a refractive index of less than or equal to about 1.55 greater than or equal to about 1.35 and nominally about 1.5. De-coupling layer 74 further has an extinction coefficient near zero. In other embodiments, de-coupling layer 74 may have other optical properties.

According to one embodiment, de-coupling layer 74 is formed from a dielectric material configured to permit transmission of ultraviolet and infra-red light and having the desired optical and surface planarization characteristics. In one embodiment, de-coupling layer 74 is formed from a spin-on glass material such as methylsiloxane silicate precursor commercially available from Honeywell Electronic Materials Company. In other embodiments, other materials may be used such as sodium silicate, Tetraethyl Orthosilicate (TEOS) ($Si(OC_2H_5)_4$) or other SOL-GEL compositions derived from silicon alkoxyde, beta-diketonate, or carboxylate precursor materials. In still other embodiments, de-coupling layer 74 may comprise other materials such as a plasma vapor deposition (PVD) or chemical vapor deposition (CVD) deposited silica.

In one embodiment, de-coupling layer 74 has a thickness of at least 2 micrometers, less than or equal to about 10 micrometers and nominally about 5 micrometers. In the example embodiment in which de-coupling layer 74 is formed from methylsiloxane silicate precursor and has the aforementioned thicknesses, de-coupling layer 74 is less prone to cracking than any other de-coupling layer chemistries.

Optical coating 76 comprises one or more layers of one or more materials deposited, formed upon or otherwise coupled to and over surface 84 of de-coupling layer 74. Optical coating 76 is configured to reflect visible light. In the particular embodiment illustrated, optical coating 76 further allows ultraviolet light and infra-red light to pass through optical coating 76 towards absorption layer 72. In one embodiment, optical coating 76 comprises a stack of multiple layers which alternate between a $TiO_2$ layer 88 and a $SiO_2$ layer 90. In one particular embodiment, each layer 88 has a thickness of 20 nanometers to 100 nanometers while each layer 90 has a thickness of about 20 nanometers to 100 nanometers. In one embodiment, reflector 44 includes between 30 and 50 total layers including layers 88 and 90. In other embodiments, optical coating 76 may be formed from one or more other materials, may have other stacked arrangements, may have greater or fewer layers and may have other thicknesses.

Overall, reflector 44 may be formed from less expensive materials, and less complex and expensive fabrication processes while providing optical and thermal dissipation benefits. In particular, reflector 44 utilizes substrate 70 formed from a metal such as aluminum that may be inexpensively fabricated and that has thermal dissipation benefits. At the same time, absorption layer 72 absorbs the ultraviolet and infra-red light that may not be permitted to pass through substrate 70 formed from a metal such as aluminum. De-coupling layer 74 intercedes between absorption layer 72 and optical coating 76 to provide optical coating 76 with a relatively smooth surface as compared to the surface of absorption layer 72 to enable optical coating 76 to better perform their intended function such as reflecting visible light.

In operation, burner 42 emits light including visible light, ultraviolet light and infra-red light within the envelope provided by reflector 44. Optical coating 76 of reflector 44 reflect the visible light in a directed manner towards a target, such as optics 22 and DMD 24 (shown in FIG. 1). Ultraviolet light and Infra-red light emitted by burner 42 passes through optical coating 76 and through de-coupling layer 74. The ultraviolet light and infra-red light are absorbed by absorption layer 72 while within the envelope or enclosure provided by reflector 44.

Figure 4A:
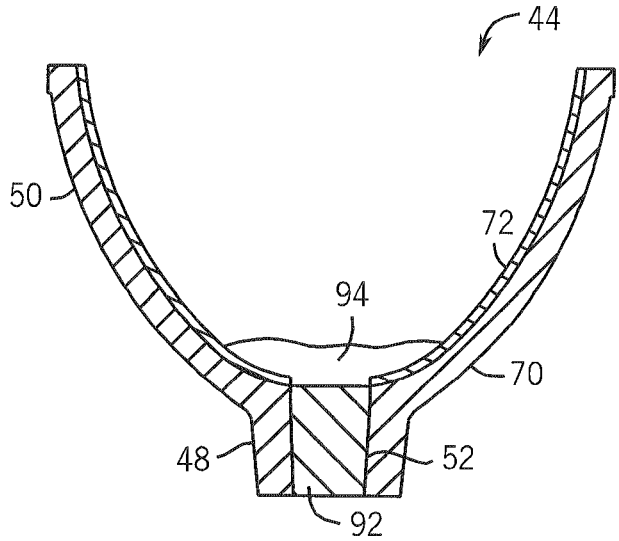
FIGS. 4A and 4B schematically illustrate one example method of forming a reflector of the light source of FIG. 2 according to one example embodiment.
Figure 4B:
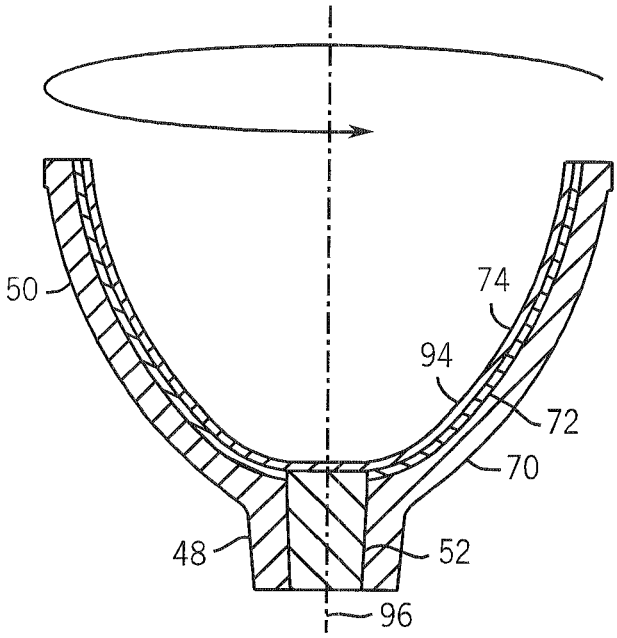

FIGS. 4A and 4B illustrate one example process for forming reflector 44. In FIG. 4A, substrate 70, providing reflector 44 with its bowl portion 50 and coated with absorption layer 72 is initially provided. Opening 52 in base 48 is sealed or otherwise plugged with a plug 92. Thereafter, a fluid de-coupling material 94 is deposited within bowl 50. In one embodiment, the de-coupling material 94 comprises a dielectric glass such as methylsiloxane silicate precursor mixed with an appropriate solvent such as 2-propanol.

As shown in FIG. 4B, substrate 70 is spun about axis 96 ventrically extending through opening 52. As a result, the de-coupling material 94 uniformly coats absorption layer 72 to provide a smooth surface for subsequent application of optical coating 76.

According to one example process, substrate 70 is mounted to a vacuum chuck (not shown) configured to support and spin substrate 70 while bowl 50 faces in an upward direction along axis 96. The vacuum chuck is further configured to plug opening 52 in base 48. According to one embodiment, substrate 70 is spun at an initial slower speed until material 94 coats substantially the entire inner surface of bowl 50 and substantially the entire surface of absorption layer 72. Thereafter, substrate 70 is spun at a greater speed. The subsequent greater speed at which substrate 70 is spun determines a thickness and uniformity of the layer of de-coupling material 94. In one embodiment, the thickness of de-coupling layer 74 (shown in FIG. 3) formed from spin coating material 94 may be further adjusted by controlling the volume of material 94 dispensed, by varying the viscosity of material 94, by varying the spin speed of substrate 70 or by varying the solvent and its evaporation rate that comprise part of material 94.

According to one example process, substrate 70 is initially spun at a speed of about 500 revolutions per minute for 6 seconds to substantially coat the entire inner surface of bowl 50 with material 94 comprising silicate precursor. Thereafter, substrate 70 is spun at a greater speed of about 1000 revolutions per minute for an additional 20 seconds to obtain a desired thickness of material 94 and to evaporate solvent in material 94. The material 94 coated upon absorption layer 72 is subsequently cured in air at a temperature of about 450° C. Additional layers of material 94 may be dispensed into bowl 50, dispersed by spinning of substrate 70 and subsequently cured to build up de-coupling layer 74 to a desired thickness.

In other embodiments, de-coupling layer 74 may be formed upon bowl 50 and upon absorption layer 72 by other techniques. For example, in other embodiments, material 94 may be dispensed into bowl 50 after spinning of bowl 50 has commenced. In other embodiments, material 94 may alternatively be dispensed along an edge of bowl 50 while substrate 70 is being spun. In yet other embodiments, substrate 70 with absorption layer 72 may be dipped in a bath of material 94, followed by spinning to achieve a desired thickness of material 94

Figure 4C:
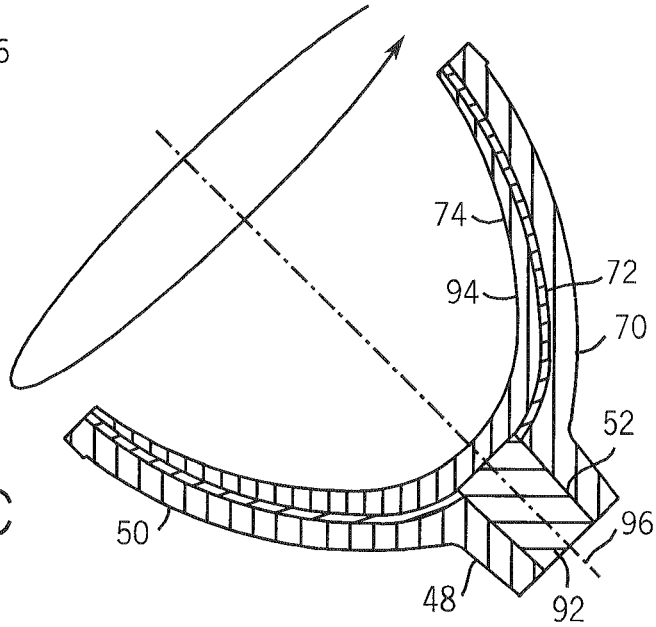
FIG. 4C is a schematic illustration of another example process of forming another embodiment of a reflector of the light source of FIG. 2 according to an example embodiment.

FIG. 4C schematically illustrates another example process for forming de-coupling layer 74. The process illustrated in FIG. 4C is similar to the process shown in FIGS. 4A and 4B except that substrate 70 is spun about axis 96 which is not vertical, but which is at an angle, to distribute previously deposited material 94 non-uniformly across absorption layer 72 within bowl 50. By adjusting the orientation at which substrate 70 is spun, the thickness and contour of de-coupling layer 74 may be adjusted to vary optical qualities of reflector 44. In one embodiment, substrate 70 may be spun at a constant orientation during spinning. In yet another embodiment, substrate 70, with deposited material 94, may be spun at an orientation that is altered or changed at constant change during spinning or at a non-uniform rate during spinning to vary the optical and reflective properties of reflector 44.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. A reflector comprising:

a substrate comprising a first surface roughness;

an ultraviolet light and infra-red light absorption layer on the substrate;

a de-coupling layer on the absorption layer, wherein the de-coupling layer is selected from a group of materials consisting of:

spun-on glass, methylsiloxane silicate, sodium silicate, tetraethylorthosilicate (TEOS) and sol-gel material; and an optical coating on the de-coupling layer;

wherein said de-coupling layer comprises a surface adjacent said optical coating having a second roughness less than said first surface roughness.

2. The reflector of claim 1 wherein the subs irate comprises a metal.

3. The substrate of claim 1, wherein the substrate comprises aluminum.

4. The reflector of claim 1, wherein the de-coupling layer is spin coated on the absorption layer.

5. The reflector of claim 1, wherein the decoupling layer has a substantially uniform thickness across the absorption layer.

6. The reflector of claim 1, wherein the de-coupling layer has an outer surface having a smoothness of at least about 20 nanometers.

7. The reflector of claim 1, wherein the de-coupling layer has an extinction coefficient near zero.

8. The reflector of claim 1, wherein the de-coupling layer has a refractive index of between about 1.35 and about 1.55.

9. The reflector of claim 1, wherein the de-coupling layer has a thickness of between 2 microns and 10 microns.

10. The reflector of claim 1, wherein the absorption layer has a surface roughness about 1 micrometer

11. The reflector of claim 1, wherein the absorption layer is selected from a group of materials consisting of:

carbon-based pigment, black anodized aluminum.

12. The reflector of claim 1, wherein the ultraviolet light and infrared light absorption layer is in contact with the substrate and is in contact with the de-coupling layer.

13. The reflector of claim 1, wherein the ultraviolet light and infrared light absorption layer is between the substrate and the de-coupling layer.

14. The reflector of claim 1, wherein the ultraviolet light and infrared light absorption layer has a first surface roughness and wherein the de-coupling layer has a surface adjacent the optical coating having a second surface roughness less than the first surface roughness.

15. A lamp comprising:

a reflector including:

a substrate comprising a first surface roughness;

an ultraviolet and infrared light absorption on the substrate;

a de-coupling layer on the absorption layer, wherein the de-coupling layer is selected from a group of materials consisting of:

spun-on glass, methylsiloxane silicate, sodium silicate, TEOS and sol-gel material; and an optical coating on the de-coupling layer, wherein said de-coupling layer comprises a surface adjacent said optical coating having a second surface roughness less than said first surface roughness; and a burner proximate the reflector.

16. The lamp of claim 15, wherein the burner comprises a high press arc burner.

17. A projector comprising:

a lamp including:

an ellipsoidal substrate comprising a first surface roughness;

an ultraviolet light and infra-red light absorption layer on the substrate;

a de-coupling layer on the absorption layer, wherein the de-coupling layer is selected from a group of materials consisting of: spun-on glass, methylsiloxane silicate, sodium silicate, TEOS and sol-gel material; and an optical coating on the dc-coupling layer;

wherein said de-coupling layer comprises a surface adjacent said optical coating having a second surface roughness less than said first surface roughness;

a burner proximate the optical coating;

a light modulator; and a color wheel through which light from the lamp passes before impinging the light modulator.

18. A reflector comprising:

a substrate comprising a first surface roughness;

means for absorbing ultraviolet and infra-red light disposed on said substrate;

means for reflecting visible light disposed on said absorbing means; and means for interfacing between the absorbing means and the reflecting means and for providing a smooth surface against the reflecting means wherein the means for interfacing comprises a material selected from a group of materials consisting of: spun-on glass, methylsiloxane silicate, sodium silicate, TEOS and sol-gel material;

wherein said interfacing means comprises a surface adjacent said reflecting means having a second surface roughness less than said first surface roughness.

* * * * *

UNITED STATES PATENT AND TRADEMARK OFFICE

CERTIFICATE OF CORRECTION

PATENT NO. : 7,507,002 B2
APPLICATION NO. : 11/173320
DATED : March 24, 2009
INVENTOR(S) : Kurt M. Ulmer et al.

It is certified that error appears in the above-identified patent and that said Letters Patent is hereby corrected as shown below:

On the face page, in field (73), in "Assignee", in column 1, line 1, delete "Hewlett Packard" and insert -- Hewlett-Packard --, therefor.

In column 1, line 25, delete "alone" and insert -- along --, therefor.

In column 7, line 5, in Claim 1, after "second" insert -- surface --.

In column 7, line 7, in Claim 2, delete "subs irate" and insert -- substrate --, therefor.

In column 7, line 13, in Claim 5, delete "decoupling" and insert -- de-coupling --, therefor.

In column 7, line 27, in Claim 10, after "micrometer" insert -- . --.

In column 8, line 12, in Claim 16, delete "press" and insert -- pressure --, therefor.

In column 8, line 23, in Claim 17, delete "dc-coupling" and insert -- de-coupling --, therefor.

Signed and Sealed this

Fourth Day of August, 2009

John Doll

JOHN DOLL
*Acting Director of the United States Patent and Trademark Office*